US006726964B1

(12) United States Patent
Thompson et al.

(10) Patent No.: US 6,726,964 B1
(45) Date of Patent: Apr. 27, 2004

(54) ULTRASONIC PROCESS FOR AUTOCATALYTIC DEPOSITION OF METAL ON MICROPARTICULATE

(76) Inventors: G. Alan Thompson, 3 Woodburn Dr, Ottawa, Ontario (CA), K1B 3A6; David E. Marx, 605 Timber La., Clarks Summit, PA (US) 18411

( * ) Notice: Subject to any disclaimer, the term of this patent is extended or adjusted under 35 U.S.C. 154(b) by 0 days.

(21) Appl. No.: 10/193,020

(22) Filed: Jul. 11, 2002

Related U.S. Application Data

(60) Provisional application No. 60/304,568, filed on Jul. 11, 2001.

(51) Int. Cl.[7] ..... B05D 1/18; B05D 7/00; B05D 1/06; B05D 1/36

(52) U.S. Cl. ..... 427/600; 427/601; 427/180; 427/475; 427/404; 427/217; 427/443.1; 427/421

(58) Field of Search ..... 427/600, 601, 427/180, 475, 404, 217, 212, 443.1, 430.1, 421; 428/402, 544

(56) References Cited

U.S. PATENT DOCUMENTS

| | | | | |
|---|---|---|---|---|
| 2,744,860 A | | 5/1956 | Rines | 204/45 |
| 4,748,737 A | * | 6/1988 | Charles et al. | 29/599 |
| 4,833,040 A | * | 5/1989 | Fishman et al. | 428/570 |
| 5,698,081 A | * | 12/1997 | Lashmore et al. | 204/212 |
| 6,368,482 B1 | | 4/2002 | Oeftering et al. | |

FOREIGN PATENT DOCUMENTS

| | | | |
|---|---|---|---|
| DE | 39 05 100 A1 | 8/1990 | C25D/21/10 |
| DE | 41 11 174 A1 | 10/1992 | C25D/5/20 |
| DE | 43 22 378 A1 | 1/1995 | C25D/5/02 |

* cited by examiner

*Primary Examiner*—Michael Barr
(74) *Attorney, Agent, or Firm*—Pendorf & Cutliff

(57) ABSTRACT

A process for depositing metal on microparticulate comprising immersing microparticulate in an autocatalytic plating bath comprising the metal; inducing ultrasonic vibration in the plating bath at a frequency corresponding to resonance frequency of the microparticulate; and inducing a turbulent vibration signal in the plating bath in a direction non-parallel to the ultrasonic vibration. This process results in the autocatalytic plating bath depositing the metal on the microparticulate with uniform thickness. The microparticulate can be spheres, flakes or microfibers, and can be made from a number of materials, such as synthetic polymers (nylon, Kevlar™, Zylon™, and aramid fibers) and biodegradable compounds. A method is disclosed for coating a surface with metallized microparticulate fibers with an orientation perpendicular to the surface.

6 Claims, 2 Drawing Sheets

ULTRASONIC PROCESS FOR AUTOCATALYTIC DEPOSITION OF METAL ON MICROPARTICULATE

REFERENCE TO RELATED APPLICATIONS

This application is a non-provisional of U.S. Provisional Application No. 60/304,568 filed Jul. 11, 2001.

FIELD OF THE INVENTION

The present invention relates generally to ionic metallic deposition onto material.

BACKGROUND OF THE INVENTION

There are many problems to be overcome in the metalizing of materials. Conventional methods for metalizing, for example silverizing, often result in uneven coating, clumping and flaking of the silver. Autocatalytic baths often result in "dead zones" where no metal application occurs.

Metalized materials are fiequently used in the aeronautic industry. The military is aerospace industry has ongoing research programs to address the issues of impedance, resistance, RF resonance, RFI (radio frequency interference)—EMI (electromagnetic interference) shielding, conductivity levels, low observability applications, thermal signature reduction and transfer, attenuation of a variety of signal types, and infrared signature reduction requirements.

Conventional methods for metalizing materials result in significant weight gain to a material, which is undesirable. For example, there are no adequate methods for metalizing air-borne particulate material in such a way that the particulate material remains light enough not to be weighed down by the force of gravity.

The ability to coat the surface with a conductive layer has value in a wide variety of technologies and applications. For example, a conductive or semi-conductive layer disposed on a surface of a dielectric material to form a composite system can be used to control the tendency of the composite system to transmit, attenuate, or reflect electromagnetic radiation incident on a surface of the composite system. Although various approaches have been taken to coat dielectric substrates with conductive layers, each of the existing method has limitations. Accordingly, there is a need to develop an improved method for disposing a conductive layer on a dielectric substrate.

Further, it is desirable to provide a process for deposition of metals onto a material that results in an even application of metal onto the material. There is a need for a process that allows for a very fine layer of metallic application on a microparticulate, so as to reduce the amount of metal required.

SUMMARY OF THE INVENTION

It is an object of the present invention to obviate or mitigate at least one disadvantage of previous processes for metal deposition onto microparticulate.

The invention provides a process of multi-phased shifted ultrasonic travelling wave ion stimulation for autocatalytic deposition of metal onto microparticulate material at the resonant frequency of the material. Advantageously, metal ions are deposited evenly onto the material using this process. Further, the invention provides metalized micropatticulate materials, such as Nylon™, Kevlar™, Zylon™, or any polymeric material that can be formed in a microparticulate size. The invention is useful for a variety of military, avionic, and industrial applications.

The purpose of this invention is to control and accelerate the transfer rate of a metal, such as ionic silver, onto sensitized microparticulate material in such a manner that permits uniformly fine deposition of the metal. By controlling the depositional thickness, the weight of the metal added to the microparticulate does not weigh down the miarticulate, thereby leaving it capable of remaining airbome for a certain period of time. This process also permits the effective de-gassing of the autocatalytic medium, eliminating problems associated with depositional voids. In turn, the thickness and quality of the metal deposition on the microparticulate material, such as nylon, Kevlar or other polymers, controls the level of conductivity designated for the end product.

The sensitized microparticulate is constantly in motion relative to the metallic solution. Consequently, the microparticulate and the medium in which it is present are put in a constant and controlled flow toward each other. This eliminates depletion zones within the autocatalytic solution, which is a common problem with conventional methods of autocatalytic plating. Thus, when the sensitized microparticulate material is drawn through the metalizing solution at a controlled rate a constant deposition of metal is applied to the material.

Metalized microparticulate materials so formed can be used in a variety of applications, including the fields of military, aerospace, or industrial and commercial products.

Further, according to the invention there is provided a method for coating a surface with metallized microparticulate in such a way that the microparticulate is either aligned, polarized or arranged randomly so as to attenuate a signal from the surface. A method for coating a surface with a coated microparticulate fibers is disclosed herein in which microparticulate being generally oriented perpendicular to the surface. The method comprises spraying the coated microparticulate from a charged nozzle onto a surface having an opposite charge to the charge of the nozzle. Optionally, the surface may be coated with two or more layers of microparticulate, each of which layer of microparticulate is metallized with a different metal, so as to allow formation of a galvanic current A method is disclosed herein for creating a surface across which a galvanic effect is observed. To accomplish this, the surface is layered with a metallized microparticulate coated with a first metal, followed by a metallized microparticulate coated with a second metal. The first metal differs from said second metal, and at least one of said first metal and said second metal is coated onto microparticulate using the ultrasonic method disclosed herein Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures.

DETAILED DESCRIPTION

Figure 1:
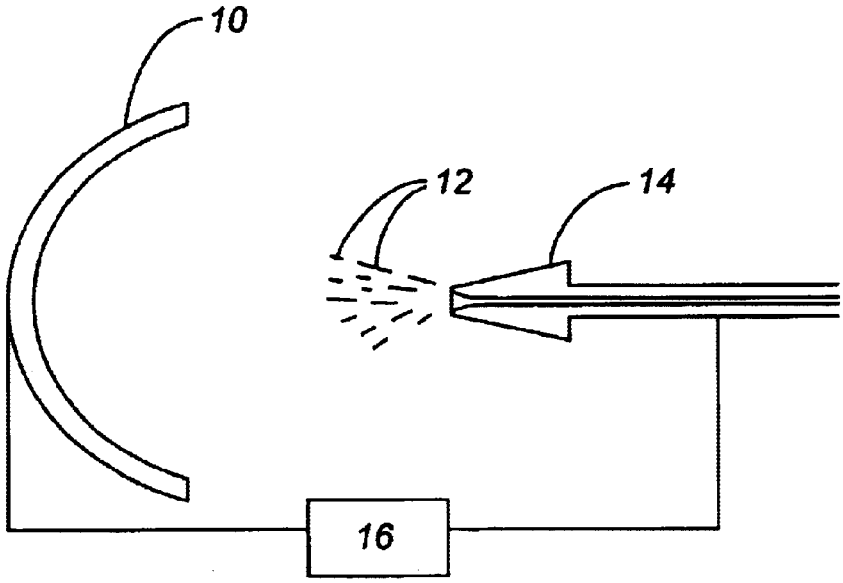
FIG. 1 shows a sectional side view of an apparatus spraying metallized microparticulate fibers onto a parabolic dish.

Generally, the present invention provides a process for depositing metal ions onto microparticulate material in such a way that allows control over deposition rate and thickness, thereby resulting in even application of the metal. Microparticulate formed according to the invention may be made so light as to be air-bome. Such microparticles would be useful in blocking transmission of electromagnetic radiation through air space.

Microparticulate Size. Micron-sized particulate may be use, for example, which may be from 0.001 $\mu$m –1 mm in diameter. The particulate need not be spherical, but may have any shape such as fibrous or flakes, geometrical shapes such as cube-shaped, round, ellipsoidal, etc. Preferably, the particulate is shaped so as to become airborne for a period of time when introduced into the air. Turbulence within the ambient surroundings may also be adequate to keep particulate airborne for a finite period of time. For some applications, it is not necessary that the microparticulate be small enough to remain air-borne.

Microparticulate Material. The microparticulate material may be any formed of substance amenable to being coated with metal.

Exemplary materials include polymeric materials, such as polypropylene, polyethylene, polyurethane, nylon, polyacrylatnide or other acrylamides, polymeric composites, copolymers, resins, teflon beads, hydrogels or aquagels. The microparticulate may have a micron-thin layer of coating before die metal is coated thereon for example, a polymeric coating may be applied to an aquagel before the metallization. The microparticulate material may be, for example, nylon Kevlar™(an aramid), other Kevlar type products (e.g. Zylon™, etc.), Nomex™ or composites of aramid or aramid-like materials. Carbon fiber, graphite, or other carbon-based materials, fiberglasss or other types of glasses, and other structural materials may be used the material onto which metal is deposited according to the invention. The material may also be synthetic or natural, organic or inorganic. Natural organic fibers, including biodegradable materials, may be used such as linen, cotton or other cellulosic or protein fibers, or silk.

By coating these microparticulate, a new particle is formed having a core around which a fine layer of metal is deposited. Formation of such particles was previously too impractical using conventional methodology.

The Metal. The metal to be deposited onto the microparticulate material using the inventive process may be any metal which is desirable to coat on a surface. For example, the metal can be selected from the group consisting of silver, tin, gold, platinum, copper, cobalt, palladium, cadmium, nickel, titanium, zinc, or other metals. An oxidized layer of certain metals coated onto microparticulate may lead to a decrease in conductivity of the microparticulate, which may be desirable in certain applications.

The process described herein is an improvement over the conventional autocatalytic metal depositional processes for coating microparticulate in that it is coupled with the use of ultrasonic resonant frequency vibrations. These vibrations are tuned to produce mechanically induced waves having the resonant frequency of vibration set to optimize movement of the microparticles. This sets the microparticles in motion within the auto-catalytic processing solutions. Perpendicular to this first set of vibrations is another ultrasonic frequency vibration tuned to produce mechanically induced wave sets at the resonance frequency vibration of each of the solution baths utilized in the auto-catalytic process. The use of the ultrasonic process in the processing baths advantageously enables the total degassing of all solutions, thereby resulting in more uniform deposition.

When ultrasonic frequency vibrations are applied to sensitized microparticulate material, a wave motion occurs resulting in a controlled, more efficient and uniform transfer of metallic ions onto the microparticulate material (e.g. woven, non-woven fabric, film, molded components), as compared to conventional autocatalytic methods.

The ultrasonic frequency vibration signalization is comprised of several components, all of which are variable and tuned according to the size and properties of the microparticulate material being processed These components are pulse width, pulse amplitude, pulse polarity and repetitive pulse frequency. The slope variables of these pulses can be sinusoidal, sawtooth or square wave. The above variables are selected according to the specific properties of the microparticulate material present in the autocatalytic solution.

A customized curved ultrasound tank, such as one based on an ellipsoid shape, for example a 60° ellipsoid, where the hyperbola axis has been extended along Y direction, can be used to prepare metalized microparticles. The tank shape optimizes the reflection of frequency waves (sonic, subsonic and ultrasonic) from the tank walls back toward the microparticles in parallel waves, without changing the amplitude or frequency. Therefore, phase nulling and deadzones are eliminated, which are common problems in conventional methods of autocatalytic metal deposition.

The ultrasonic directional transducers may be are located along the horizontal length of the tank. They are located under the lip of the tank and may be at staggered heights above the floor of the tank. The ultrasound vibrations are directed at the material to be metalized and tuned to produce mechanically induced wave sets to the resonance frequency vibration of the specific thread diameters and cross-sectional densities of the material drawn through the auto-catalytic processing solutions.

Perpendicular to this first set of vibrations is another subsonic, sonic, ultrasonic frequency vibration tuned to produce mechanically induced wave sets at the resonance frequency vibration of each of the solution baths utilized within the autocatalytic process. This ultrasound vibration will be perpendicularly pulsed to induce a convection current flow through the fluid. This will allow even solution mixture and total degassing of the solutions. These vibrations are generated from a set of ultrasound directional transducers permanently secured to the bottom of the tank located directly below the tank top opening. When the vibrations are generated, they move up through the tank and move out into the air with little to no vibration reflection. It is beneficial to minimize vibration reflection from these transducers.

The ultrasonic frequency vibration signalization may include several optional components, each of which may be variable and tuned according to the microparticulate material being processed. The variables are programmed into the ultrasonic transducers prior to introducing the material into the autocatyalic process, allowing further control over the ultrasonic autocatalytic process of metal deposition.

The ultrasound tank shapes are customized to reflect the ultrasound waves, without changing the amplitude or frequency, through the fluid.

The ultrasound generators are placed within the sensitizer, rinse and depositional bath tanks, rat adjustable levels. The generators can be vertically and horizontally movable in the tank so as to accommodate fluid in the tank and width of material. The ultrasound vibrations are tuned to produce mechanically induced wave sets to the resonance frequency vibration of the microparticulate within the autocatalytic processing solutions.

Perpendicular to this first set of vibrations is another ultrasonic frequency vibration tuned to produce mechanically induced wave sets at the resonance frequency vibration of each of the solution baths utilized in the autocatalytic process. This set of ultrasound generators may be permanently placed adjacent to the walls of the tank. The location of the generator array will be dependent on the fluid in the tank. The use of the ultrasonic process in all processing baths enables the total degassing of all solutions.

Two sets of transducers may be used to induce waves within a tank. One transducer can be placed in the tank so that an ultrasound emitter may be placed at the bottom of the tank. The sonics induced by these transducers rise through the solution. Another transducer is poised to emit sonics across the tank, horizontally. The two sets of waves in this example result in an oscillation and energy-transfer to the microparticles. This allows the particulate a mechanical ion bonding when exposed to the metal, which is a covalent bond, not a plating bond. The current to the transducers may be increased for heavier particles, so that adequate turbulence is induced within the tank. Transducers may be placed within the tank, either permanently or in a manner that renders the transducers removable.

Removal of particles from the tank for the purposes of transferring into another bath can be done in any manner desirable. For example, the particles may be pumped out of the tanks with the tank fluid and then separated, for example by filtration or certification. A liner bag may be used where appropriate, which can removed and placed into a subsequent bath. Such a liner bag would be of an adequately small mesh size so as to retain the majority of the microparticulate. Size-exclusion filtration can also be used to remove particles from the tank.

The ability to control the conductivity of the material, through varying the amount of metal deposited on the microparticulate material. The invention further allows control of the conductivity of the microparticulate material, through varying the amount of metal deposited on the material which enables customized shielding for microwave absorption. At the present time expanded copper foil is used to shield personnel from microwave radiation. However, air-borne metalized microparticles provide an optional mode of customized shielding from microwave radiation.

The ability to control the conductivity of the material through varying the amount of metal deposited on the microparticulate material, enables customized thermal and infrared shielding The thermal and infrared signature generated in the aircraft is reduced by two methods: shielding and conductivity. Thermal signature reduction is an important component for stealth technology in military low observability aircraft.

Advantageously, the metal deposition according to the invention is uniform, thin and controlled.

Microparticulate formed according to the invention can be used for a variety of applications as outlined hereinbelow, but is not limited to such applications.

This ultrasonic autocatalytic process allows metallic deposition onto microparticles to be controlled in order to achieve desired amount of deposition. Once coated, microparticulate may be used in such applications as RFI-EMI shielding, for low observability applications, or thermal signature reduction, particularly if the microparticulate remains light enough to be airborne.

Particles, such as fibers coated with metal may be used to block or attenuate signals, such as for example radar signals, and various frequencies of signal may be blocked by varying the size of the microparticulate used. For example, different lengths of fibers may be used to block or attenuate radar signals.

The variable/fixed frequency ultrasonic autocatalytic process enables the regulation of the distribution and amount of metal deposited on a microparticulate material, and thus allows control of the conductivity of the material. Metals can be deposited on microparticles to create a consistent impedance/resistivity level in the range of 1000, 600, 300, 10 ohms to milli-ohm, micro-ohm levels and conductivity ranging from amps to micro-amps can be used for low observability applications.

Coating Surfaces with Metallized Microparticulate. The invention may be used to form a material coated with metalized microparticulate, including a substrate formed of dielectric polymeric material. The dielectric polymeric material may be formed of a composite including a resin and reinforcing fiber material. The resin my be an epoxy resin, or a non-epoxy resin such as acrylic resin. The reinforcing fiber may be a fiberglass fiber material, a carbon fiber material, a polymer fiber material such as polyamid or polyaramid fiber or other organic or inorganic fiber.

A layer of microparticulate material may be disposed above a surface of a surface to be coated, for example the dielectric polymeric material. The metalized microparticulate material includes fibers of organic polymer.

An apparatus for depositing a layer of metallized microparticulate material, such as silverized fibers, can be used to embed the microparticulate material into a resin layer on a surface to be coated. The resin layer allows the microparticulate to stick to the surface to be coated. Of course, any other compound capable of allowing microparticulate to stick to a surface may be used. If the microparticulate is applied in such a way that it is embedded in the surface to be coated, a resin or other type of sticky compound would not be required. The surface to be coated may be an independent dielectric material, or may be a portion of a functional structure such a radome.

The invention allows application of metallized particulates, such as fiber, onto a surface to be coated. In this example, a silverized particulate fibre (Nylon™, Kevlar™, aramid fibers etc.) is used.

A controlled deposition rate can be used to apply the silverized fibers to a surface, so as to achieve a specific resistance, impedance, conductance value or property. One skilled in the art can determine the desirable deposition rate required.

Controlled deposition, and controlled use of different microparticulate sizes and shapes can be used to achieve attenuation of a specified frequency or frequency sensitive spectrum. At the metallization stage, by controlling particulate size (length, width, diameter) to be coated, the choice of frequencies to attenuate can be determined Additionally, the purity of silver deposited on the microparticulate and the percentage of silver deposited by weight on the microparticulate can be controlled to allow manipulation at the metallization stage.

Once metalized microparticulate is coated, the application of the microparticulate to a surface can be controlled. For example, orientation of the microparticulate, including layer thickness and/or number of layers can be manipulated to achieve the desired result.

Mechanical control of the deposit of microparticulate onto the surface to be coated can be used so that full control of the orientation of the microparticulate along each of the X, Y and Z axes can be achieved. Directional orientation of the metalized microparticulate can be accomplished by varying electrostatic charge on the objective target to be coated. Further, the velocity with which the microparticulate is coated on the substrate can be manipulated to achieve different effects as desired.

Microparticulate may be deposited onto the surface in a polarized manner, for example when the microparticulate is asymmetrically shaped. This effect can be achieve by creating opposed polarization at the discharge nozzle and the surface to receive the microparticulate. In this way, asymmetrical microparticulate (such as fibers) may be oriented in a manner that is generally perpendicular to the surface to receive the particulate.

The density of the metallized microparticulate being deposited can be manipulated, and the polarization of the microparticulate leaving the discharge nozzle can be controlled. Also the spray angle of the discharge nozzle and distance between the face of the target and the discharge nozzle can be manipulated to permit microparticulate alignment on a target surface.

In some instances, it would be beneficial to allow the metallized microparticulate to be deposited "end on" on the surface to be coated, and all particulate to be coated onto the surface would be aligned with similar orientation. In this way, varying lengths of fibers may be used to coat a surface, for the purpose of attenuating a variety of different signals, each corresponding to different lengths of fibers. An advantage of blending lengths and/or sizes of particulate is that it promotes selective control of the frequencies that a material would absorb or reflect, for example when applied to antennaes and sonar arrays.

Alternatively, the microparticulate may take on a random orientation on the surface to form a "felt". A felt can be considered as a layer of non-woven fibres deposed with non-uniform, unorganized or random orientation, so as to overlay or interlace with one another within a layer.

In order to effect polarization, any appropriate means can be used. A neon light type transformer apparatus could be used as an initial charging source to give the electrostatic charge level necessary to the discharge nozzle and/or the surface to be coated with the microparticulate.

The metallized microparticulate layer may itself be conductive, or may be non-conductive but capable of effecting frequency-dependent attenuation.

Metalized Microparticulate Matrix. The microparticulate to be metalized may be a polymer, for example Kevlar™, Nylon™, Teflon™. Once metalized, the microparticulate can be sprayed, applied to, or deposited on to another surface. Alternatively, the microparticulate may be encapsulated in a polymeric matrix in order to render it electrically conductive in order to provide EMI shielding or signal attenuation. When applied to a polymeric matrix, the microparticulate may be use as a selective shield, allowing the passage of some frequencies, but blocking other frequencies, depending on the length, breadth and loading of the microparticulate in the matrix.

Formation of Electrical Pathways. The invention allows for formation and control of electrical pathways, if the metalized micropatticulate is deposited on the surface polymer in a pattern appropriates to carry a current. The metalized microparticulate may be used alone or in combination with appropriate fibrous materials and pulped (using appropriate length and breadth of microparticulate) so as to form a lightweight conductive paper for use in architectural shielding.

Conductivity Through a Polymer. By controlling the orientation and direction of short fibers (when microparticulate is relatively large, conductivity can be imparted through a polymer (in the z-direction), which is an effect that cannot be achieved using conventional methods of metal plating.

Generation of Galvanic Current. By layering two different types of microparticulate on a surface, the two types of microparticulate having different metal coatings, the layered structure can have a galvanic current generated therethough, so as to create a conductive or semi-conductive effect.

For example, microparticulate may be separated into two groups, A and B. Group A is coated with a first metal, for example silver. Group B is coated with a second metal which may be any metal other than the metal used to coal group A, for example: gold, copper or any other metal having a different conductivity than silver.

The surface onto which the two different types of metallized microparticulate are coated may be formed of any suitable material, such as a metallic or polymeric surface.

By forming a galvanic current through layered coating with two dissimilar types of metalized micro particulate, the coated surface can exhibit a thermocouple action. Having the two dissimilar metal layers also gives the coated surface diode characteristics, which can also be considered to be a semi-conductor state.

This effect of having the dissimilar layers of microparticulate can result in a thermocouple activity across the coated surface, will allows for a thermocouple (or temperature sensing) layer. Galvanic current changes can be sensed across the surface, for example: temperature, physical structure, stress or fractures in the surface on which the microparticulate is coated can be sensed. This application facilitates the sensing of not only temperature, but also cracks or changes in a surface. This application of dissimilar layers can act as a "strain gage", or a stress measuring device (resistor), when resistance, current or voltage is measured across a surface coated with dissimilar layers.

Mobilized Free Microparticulate. Once microparticulate has been metalized, it can be mobilized in an air-space so as to enable customized shielding for EMI (electromagnetic interference) and RFI (radio frequency interference). Solid members are currently used for blocking electromagnetic and radio frequencies. However, the possibility of using microparticulate offers a lower mass alternative to using a solid metalized component.

Military Chaff for Jamming of Seeking Weapons. Conventional chaff is released behind military aircraft and floats behind the aircraft creating a multi-target blanket to confuse weapons directed at the aircraft. Conventional chaff is composed of aluminum ribbon foil. This material pollutes the environment once it hits the ground and may be toxic if consumed by domestic and wild animals.

Biodegradable microparticulate uniformly deposited with a metal, such as silver, is a lightweight alternative to aluminum ribbon foil. When dispersed into the air the microparticulate will float to the ground and dissolve within days. Minute quantities of metal, such as silver will be the only end product and is not toxic if consumed in small quantities. The microparticulate may be in the form of flakes, spheres, or any other shape amenable to being airborne.

Radar Blocking. The microparticulate formed according to the invention may be used to block radar frequencies. Frequencies of from 0.8 GHz to 30 GHz can be blocked by mobilizing the microparticulate according to the invention. Blocking will continue to occur for the period of time over which the particles remain airborne.

Camouflage. Putting the metallized particulate down on surface in a pattern allows for a "camouflage effect" for thermal shielding. Some heat would transfer through a fabric surface and some would stay in. A surface can may be "painted" with microparticulate in any desired image, for example on the surface of a fabric. If an individual wearing a garment formed of such a fabric, this would cause a change in the appearance of the individual when viewed through night vision goggles.

Use of Coated Surfaces as a Battery. A surface on which microparticulate forms a layered structure (having galvanic effect) could be used as a lightweight battery. The surface onto which the microparticulate is coated could be a fabric, which may be rolled out, and used as a solar cell. Such a solar cell collects energy and generates a current. Further, it could also be used on a panel of a satellite to generate current

General Methodology

According to the invention, a phase shifted resonant frequency vibration is accomplished through the use of signal generation systems with a frequency spectrum that produces a mechanically induced wave set to the resource frequency vibration according to the various sizes and densities of the microparticulate material drawn through the solution. The solution properties may also impact on the frequency of vibration Sensitized microparticulate material set to undulate in solution permits a more efficient transfer of metallic ions onto a microparticulate material. Vibration of the material contributes to the controlled rate of ionic deposition and depletion of the auto-catalytic medium The inventive process allows for a controlled depositional transfer rate of metallic ions uniformly onto the microparticulate material suspended in the auto-catalytic solution. Variances in the cross-sectional density of the microparticulate can be dealt with by adjusting the wavelength, pulse width, amplitude, power level variability in the sonic signalization. This signalization comprises several components, all of which are variable and tuned according to the material being processed. These components are pulse width, pulse amplitude, pulse polarity and repetitive pulse frequency. The slope variables of these pulses can be sinusoidal, sawtooth or square wave. The above variables are selected according to the specific properties of the microparticulate material suspended in the solution.

A similar signalization, perpendicular to the initial wave is simultaneously introduced into the metallic ion solution Again, the variables are reactive to the resonance vibration inherent to the metallic ion solution properties. When combined, the vibrations permit an effective and controllable ionic auto-catalytic transfer from the solution onto the sensitized material.

The inventive process improves upon conventional autocatalytic metal depositional processes, because it involves the coupling of autocatalytic metal deposition with the use of fixed and variable ultrasonic phase shifted resonant frequency vibrations.

The inventive process enables the total degassing of all solutions used in autocatalytic and electrolytic processes beginning with the stripping sensitizing to the final end product neutralizing and rinse stages. The process permits a quality assurance such as materials meeting high standards of metal purity when applied to organic and inorganic microparticulate material.

The process permits metallic deposition to be controlled in order to achieve desired impedance, resistance, conductance, RF resonance, RFI-EMI shielding, low observability applications, thermal signature reduction or infrared signature reduction requirements.

There are a variety of applications for microparticulate materials that have had metal ions applied using the depositional process described herein.

Silver, tin, gold, platinum, copper, cadmium, nickel, titanium, zinc, or other metals can be is applied to microparticulate using the inventive process.

The following process steps can be followed to coat microparticulate with silver. 1) Weigh material. 2) Calculate chemicals to be mixed for each bath according to standard formulae. 3) Silver of high 99.999999%/o purity is used All other chemicals used in the process are also of high purity. 4) The microparticulate is deposited into a bath, within a mesh filter having a pore size capable of retaining the micropatticulate, and is moved though the processing baths in this manner. 5) Material is drawn into a surfactant bath for cleaning.

6) The ultrasound units installed in each processing bath (cleaning. rinse, sensitizer and depositional) vibrate the microparticulate material at its specific resonant vibration frequency. The frequency is set to match the resonant vibration of the microparticulate. In each bath, the ultrasound parameters are set so as to correspond with the resonant vibration frequency of the material. The ultrasound de-gasses the material and the surfactant. All transducers are liquid cooled.

7) The time period over which the microparticulate stays in the surfactant bath is dependent on the type, the density and average size of the microparticulate. Any known contamination that needs to be removed from the material prior to the sensitizing and depositional baths.

8) Material is removed from the surfactant bath and immediately processed to remove all excess surfactant from the material. A centrifuge is used to precipitate the microparticulate material, and the supernatant is drawn off.

9) The microparticulate is drawn though one or more deionized rinse baths in which the ultrasound waves correspond with the resonant vibration frequency of the material.

10) The number of rinse baths the material is drawn through depends on the type (texture, size, density, weight, composition, etc.) of the material, as well as the amount of metal deposition required.

11) The material is centrifuged and/or filtered after each rinse bath.

12) Additional material surface stripping may be needed to strip off an electron from the material i.e. Kevlar™, Zylon™, Nylon™, or other polymers. In the case of Kevlar™ the microparticulate is submerged in a solution of methanol and dimethyl sulfoxide (1 to 10 ratio) with a continuous argon gas flow through a closed container. To this solution add an equal amount of potassium tert-butoxide in grams as the methanol. The Kevlar™ remains in this solution until it changes from pale yellow to bright orange. Remove immediately or the solution will affect the inherent properties of the Kevlar™.

13) The microparticulate is drawn into a sensitizing bath and remains in the bath, dependent on the material and the metal to be deposited. The ultrasound waves in the bath correspond with the resonant vibration frequency of the material. A second ultrasound with a positive or negative pulsed wave, in either a sinusoidal, square or sawtooth form, is directed such that a current flow is induced in the solution This oblique ultrasonic and sonic pulsed induced current flow will ensure that a constant coherent mixing occurs thus eliminating any depletion zones. The repetitive pulse rate and magnitude of the pulse width and amplitude control the rate of mixing. Sensitizer solution composition is dependent on the material and the type of metal that will be deposited onto the material. In the case of nylon 6 and Kevlar being deposited with silver, the sensitizer is composed of 4% tin chloride and hydrochloride acid solution of a pH of 1. The material remains in the tin solution for 6 minutes. The ultrasound will also de-gas the material and the sensitizing solution 14) The microparticulate is drawn out of the sensitizing bath and either filtered or centrifuged after passage through several rinse DI baths.

15) In each rinse bath the ultrasound vibrates at the resonant frequency of the microparticulate. The ultrasound will de-gas the material and the rinse water.

16) The microparticulate is drawn into the autocatalytic solution. The solution is composed of chemicals dependent upon the metal to be deposited onto the material. The ultrasound waves in the bath correspond with the resonant vibration frequency of the material. A second ultrasound with a positive or negative pulsed wave, in either a sinusoidal, square or sawtooth form, is directed such that a physical current flow is induced in the solution. This oblique ultrasonic and sonic pulsed induced current flow will ensure that a constant coherent mixing occurs thus eliminating any depletion zones. The repetitive pulse rate and magnitude of the pulse width and amplitude control the rate of mixing. The ultrasound will also de-gas the material and the autocatalytic solution. A silver autocatalytic solution shall be used as an example for the purpose of this disclosure. This solution chemical composition is used in conventional autocatalytic processes. A typical procedure is outlined below in steps a) to f).

a) Silver nitrate is dissolved in DI water.

b) Ammonia hydroxide is added to the silver nitrate mixture until the reaction changes from brown to clear.

c) The tin-coated microparticulate is placed into the surfactant bath. The ultrasound is set at the frequency of the microparticulate. The microparticulate is stirred continuously.

d) Add all of the silver nitrate mixture into a surfactant bath. The perpendicular ultrasound wave is set at the resident frequency of the solution.

e) The two ultrasound waves moving through the solution promote the deposition of the silver (metal) onto the microparticulate surfaces.

f) Slowly add ½ of the formaldehyde to the silver solution bath—stirring material constantly. After about 10 minutes can add ¼ more formaldehyde and the remainder after a time frame dependent upon the volume of microparticulate to be coated.

17) The microparticulate is drawn out of the autocatalytic bath at a rate dependent upon the percentage of metal to be deposited upon the microparticulate. This rate is dependent upon: a) the end use of the microparticulate; b) volume of the microparticulate to be processed; c) size and density of the microparticulate; and d) the temperature of the autocatalytic solution.

18) The microparticulate is rinsed in a DI bath to remove all excess metallic solution. The ultrasound waves in the bath correspond with the resonant vibration frequency of the microparticulate.

19) The microparticulate is passed through a filter and/or is centrifuged and the supernatant removed, so as to remove excess solution. Microparticulate can then be dried using warm air or a method appropriate to the type of material.

20) The final coated microparticulate is stored in such a way to avoid clumping of particulate in preparation for packaging.

EXAMPLE 1

Multi-Phased Shifted Ultrasonic Travelling Wave Ion Stimulation for Effective Autocatalytic Deposition of Silver onto Kevlar Microparticles at Resonance Frequency Vibration The process according to the invention allows control and acceleration of the transfer rate of ionic silver onto sensitized microparticulate material in such a manner that permits uniform silver deposition, thus controlling the depositional thickness and eliminating problems resulting from clumping. This process also permits the effective de-gassing of the autocatalytic medium, eliminating problems associated with depositional voids. In turn, the thickness and quality of the silver deposition on the microparticulate controls the level of conductivity designated for the end product This process works two fold; such that the sensitized material is in motion perpendicular to the motion of the silver solution, which in turn is actively in motion by a second alternating phase shifted frequency at resonant vibration frequency. Consequently, the two induced motions are in a constant and controlled flow toward each other. This motion eliminates depletion zones within the autocatalytic solution. Thus, when the sensitized microparticulate material is suspended in the silver solution, the microparticulate follows the motion introduced into the solution, allowing a constant deposition of silver to be applied to the material.

A customized ultrasound tank based on a 60° ellipsoidal shape where the hyperbola axis has been extended along Y direction is formed. The tank shape optimizes the reflection of frequency waves (sonic, subsonic and ultrasonic) from the tank walls back toward the microparticulate in parallel waves, without changing the amplitude or frequency. Therefore, phase nulling and dead-zones are eliminated.

Ultrasonic directional transducers are located along the horizontal length of the tank. They are placed under the lip of the tank at staggered heights above the floor of the tank. The ultrasound vibrations are directed into the tank so as to mobilize the microparticulate therein, and are tuned to produce mechanically induced wave sets to the resonant frequency of vibration of the specific diameters and densities of the microparticulate within a given auto-catalytic processing solution.

Perpendicular to this first set of vibrations is another ultrasonic frequency vibration tuned to produce mechanically induced wave sets at the resonance frequency vibration of each of the solution baths utilized within the autocatalytic process. This ultrasound vibration is perpendicularly pulsed to induce a convection current flow through the fluid. This allows an even mixing of the solutions and the total degassing of the solutions. These vibrations are generated from a set of ultrasound directional transducers permanently secured to the bottom of the tank located directly below the tank opening When the vibrations art generated they move up through the tank and out into the air with little to no vibration reflection. It is beneficial to minimize vibration reflection from these transducers to prevent 180° phase shift of the convection current, producing pulses emitted from the transducers.

A process for depositing a metal on microparticulate according to the invention may comprise the steps of: connecting a signal generator to a fist transducer and a second transducer, placing the microparticulate in an autocatalytic plating bath comprising the metal, and coupling the first transducer to the plating bath. The second transducer can be coupled to the microparticulate, driving the first transducer with the signal generator and applying a first vibratory signal to the plating bath using the first transducer. The second transducer can be driven with the signal generator, and a second vibratory signal can be applied to the microparticulate material using the second transducer.

Bath volume can be calculated by estimating, for example, that 10 g of microparticulate requires 250 mL of sensitizing solution. Thus for 193 g silver nitrate 96.5 liters of autocatalytic solution is required.

The ultrasonic frequency vibrations are applied to sensitized microparticulate, thereby causing a sinusoidal undulating wave motion resulting in a controlled, efficient and uniform transfer of silver ions onto the microparticulate. A controlled depletion rate of silver from the autocatalytic medium results.

Microparticulate is removed from the tank using a filter of an appropriate pore size small enough so as not to allow the microparticulate to pass through. Microparticulate is rinsed as required and placed in a subsequent bath, as required

EXAMPLE 2

Polarized Application of Metallized Microparticulate onto a Surface

In order to apply metallized microparticulate onto a surface, any variety of methods may be employed.

FIG. 1 illustrates application of silverized microparticulate onto a surface. In this example, a parabolic dish (10) provides an appropriate object target for application of metallized microparticulate in the form of silverized fibers (12) of varying lengths. A discharge nozzle (14) having an inert carrier gas (such as Ar, $N_2$, He, etc.) travelling therethrough delivers the silverized fibers to the surface of the parabolic dish. The parabolic dish may optionally be pretreated with a resin layer (such as an epoxy) to ensure that the fibers become lodged onto the surface of the dish. In order to orient the fibers end-on so as to be approximately perpendicular to the dish, an electrostatic charge generator (16) can be used to oppositely charge the dish (10) and the discharge nozzle (14). In this way, as the fibers are blasted out of the discharge nozzle via the carrier gas, they become oriented in a polarized fashion when lodged onto the surface of the dish, within the resin layer if present. The apparatus of the nozzle attached to an inert gas source and the electrostatic charge generator comprise an apparatus for spraying metallized fibers onto a surface. The gas may be used at any flow rate appropriate for the desired type of metal coverage. A blast of up to 20,000 psi. or greater can be employed.

The electrostatic charge generator may charge a substrate at any appropriate level, for example of from 20–60 kV. The nozzle and the target object to be coated are in contact with the generator so that one is positively charged and one is negatively charged, thereby polarizing the metallized microparticulate flowing therethrough.

Figure 2:
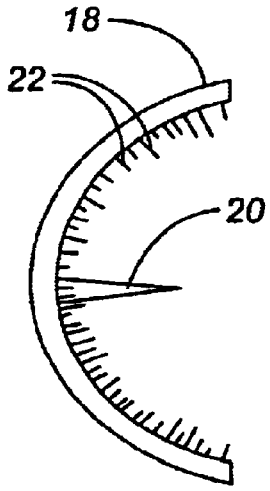
FIG. 2 illustrates a sectional side view of a parabolic dish onto which metallized microparticulate fibers of differing lengths have been sprayed and polarized so as to stand generally perpendicular to the surface of the dish.

FIG. 2 shows a side view in section of a parabolic dish (18), having a horn assembly (20) within the forward-facing curvature thereof. The forward-facing surface of the dish has been coated with an epoxy resin layer (not shown), and subsequently has been coated with a layer of microfibers of different lengths (22) using an electrostatic charge apparatus similar to that shown in FIG. 1. As can be seen in FIG. 2, the microfibers become oriented generally perpendicular to the surface of the dish. The microfibers may range in length of from 0.1 mm to 1 cm in length in this example and may be about 5 denier in diameter (such as monofilament fibers), so as to block a plurality of frequencies. In this case, radar frequencies ranging from 0.5 to 40 GHz may be blocked or attenuated by the perpendicularly oriented silverized microfibers.

Figure 3:
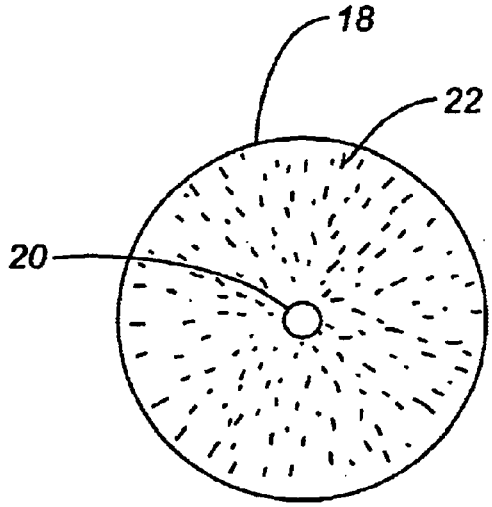
FIG. 3 is a front view of the parabolic dish of FIG. 2.

FIG. 3 illustrates a front view of the dish shown in FIG. 2. An advantage of blending lengths and/or sues of particulate is that it promotes selective control of the frequencies that a material would absorb or reflect, for example when applied to antennaes and sonar arrays, such as for example those having a dish-shape.

EXAMPLE 3

Figure 4:
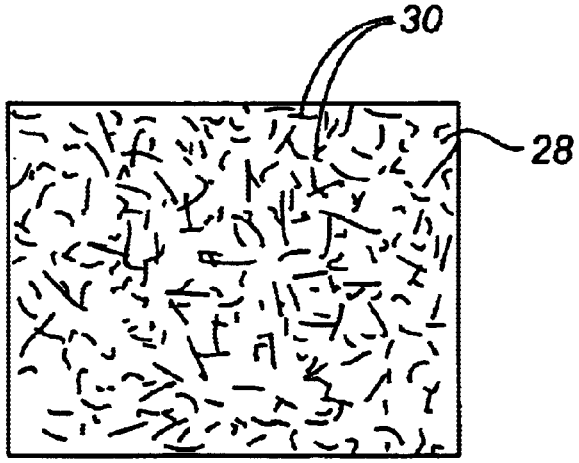
FIG. 4 is a front view of a surface on which metallized microparticulate fibers have been felted

Combined Felted and Polarized Application of Metallized Microparticulate Onto a Surface In order to apply metallized microparticulate onto a surface that required different types of metal coverage, any layered technique may be employed FIG. 4 illustrates the front view of a flat surface (28) on which metallized microparticulate fibers (30) of varying sizes and lengths formed according to the methodology described herein, have been "felted". By "felted" it is meant applied in a random or unorganized fashion. This layer has not been polarized to effect an end-on orientation. In order to ensure adherence of the felted fibers to the surface, a resin layer may be included on the surface prior to application of the microparticulate. After application of the felted layer of metallized microfibers, a subsequent layer of polarized metalized microfibers is applied, using an apparatus such as that shown in FIG. 1.

Figure 5:
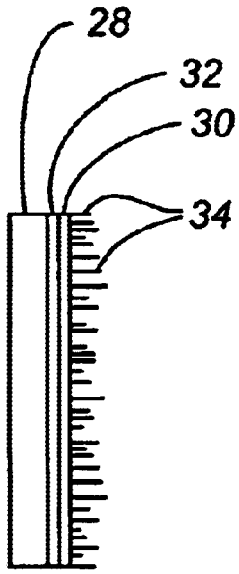
FIG. 5 is a side view of a surface having a resin layer, a layer of felted metallized microparticulate fibers, and layer of polarized metallized microparticulate fibers located thereon.
Figure 6:
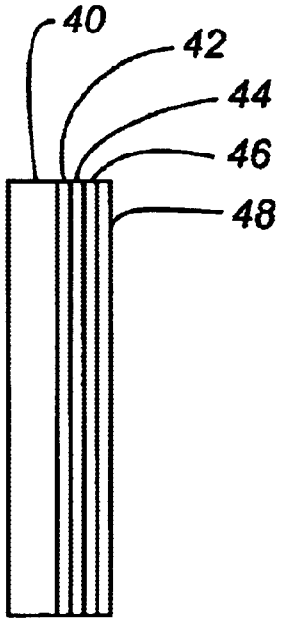
FIG. 6 is a side view of a surface having an initial resin layer, a felted layer of silverized micropatticulate fibers, a further resin layer, and a layer of copper-coated microparticulate fibers are located.

FIG. 5 illustrates a flat surface (28) having a resin layer (32) coated thereon, followed by a felted layer of metallized microparticulate (30) of varying sizes. A final layer of metallized microparticulate (34) oriented generally perpendicular to the surface is applied as the final layer. The surface shown in FIG. 5 not only has signal attenuating properties corresponding to the lengths and widths of the fibers used, but also provides a general metal coverage of the surface.

EXAMPLE 4

Dual Layer Application of Metallized Microparticulate to a Surface to Create a Galvanic Effect In order to create a galvanic effect across a surface, dual layers of coated microparticulate may be used. In this example, a flat surface (40) is coated first with a resin layer (42), followed by a layer of silverized microparticulate particles (44), an (optional) lightly applied resin layer (46), and a subsequent layer of copper-coated microparticulate fibers (48) formed as described herein. This surface so coated allows temperature sensing across its surface, as well as detection of any changes in integrity (such as stresses or cracks), using standard galvanic detection methodology due to the dual layer of microparticulate coated with different types of metal.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A process for depositing a metal on a microparticulate comprising the steps of: immersing microparticulate in an autocatalytic plating bath comprising the metal; inducing an ultrasonic vibration in the plating bath at a frequency corresponding to a resonance frequency of the microparticulate; and inducing a turbulent vibration signal in the plating bath in a direction non-parallel to the ultrasonic vibration, whereby said autocatalytic plating bath deposits the metal on the microparticulate and wherein the turbulent vibration comprises a sub-sonic, sonic or ultrasonic vibration.

2. The process according to claim 1 wherein the microparticulate has a form selected from the group consisting of spheres, flakes, and microfibres.

3. The process according to claim 1 wherein the metal is silver, tin, gold, platinum, copper, cobalt, palladium, cadmium, nickel, titanium, or zinc.

4. A method for coating a surface with a coated microparticulate fibers formed according to the method of claim 1, a said microparticulate being generally oriented perpendicular to the surface, the method comprising the step of spraying said coated microparticulate from a charged nozzle onto a surface having an opposite charge to the charge of the nozzle.

5. A method for creating a surface across which a galvanic effect is observed, comprising layering on the surface a metallized microparticulate coated with a first metal, followed by a metallized microparticulate coated with a second metal, wherein said first metal differs from said second metal, and at least one of said first metal and said second metal is coated onto microparticulate using the method of claim 1.

6. The process according to claim 1 wherein a substantially uniform thickness of metal is deposited on the microparticulate.

* * * * *